United States Patent [19]

Allen et al.

[11] 3,984,309

[45] Oct. 5, 1976

[54] MAGNETIC SEPARATOR

[76] Inventors: James W. Allen, 8 Dover Court, Orinda, Calif. 94563; Joseph Iannicelli, 157 Darien Highway, Brunswick, Ga. 31520

[22] Filed: Sept. 27, 1974

[21] Appl. No.: 509,874

[52] U.S. Cl. ..... 209/214; 209/223 R; 209/232

[51] Int. Cl.[2] ..... B03C 1/00

[58] Field of Search ..... 209/214, 39, 40, 223 R, 209/232; 210/222, 223

[56] References Cited

UNITED STATES PATENTS

| | | | |
|---|---|---|---|
| 555,792 | 3/1896 | Wetherill | 209/214 X |
| 823,235 | 6/1906 | Wait | 209/223 R |
| 1,056,318 | 3/1913 | Bruck | 209/232 |
| 1,093,875 | 4/1914 | Mottinger | 209/232 |
| 1,317,992 | 10/1919 | Jekinger | 209/223 R |
| 1,491,600 | 4/1924 | Fernow | 209/232 |
| 2,979,202 | 4/1961 | Orbeliani | 209/223 R |
| 3,279,602 | 10/1966 | Kottenstette | 209/214 |
| 3,289,836 | 12/1966 | Weston | 209/214 |
| 3,567,026 | 3/1971 | Kolm | 210/222 |
| 3,608,718 | 9/1971 | Aubley | 209/214 |

FOREIGN PATENTS OR APPLICATIONS

| | | | |
|---|---|---|---|
| 691,038 | 7/1930 | France | 209/223 R |

*Primary Examiner*—Robert Halper
*Attorney, Agent, or Firm*—Townsend and Townsend

[57] ABSTRACT

A continuous flow magnetic particle separator and accompanying classification method is disclosed for ferromagnetic and paramagnetic particles. A magnetic field is generated, preferably by a coil or solenoid mounted interiorly of a cylindrically configured ferromagnetic conductor. The classification volume is located in a typically toroidal volume interior of the magnetic field. The field is typically confined by a ferromagnetic conductor where it passes externally of the classification or toroidal volume. The toroidal volume is positioned so that lines of magnetic intensity from the field extend transversely to toroidal volume at the flow from input to collectors. The classification volume has a large gap in the vicinity of the input and tapers to a smaller gap in the vicinity of the concentrate (or magnetic particle) and tailings (or non-magnetic particle) collectors. The concentrate collectors are immediately adjacent to both walls of the toroidal classification volume. The tailings collector is between the concentrate collectors. Where a ferromagnetic conductor is conformed to the classifying volume walls, concentration of a three-dimensional magnetic field results. As a result, the collection area for non-magnetics or tailings can be maximized, and the collection area for the magnetics or concentrates can be minimized with the resultant inevitable entrainment of non-magnetic tailings in the concentrate held to a minimum. Further, the magnetic field assists magnetic particles in passing through the classifier. Water washing of the concentrate exit to prevent magnetic clogging is disclosed.

21 Claims, 11 Drawing Figures

MAGNETIC SEPARATOR

This invention relates to a magnetic separator of the continuous flow variety wherein mixed non-magnetic and magnetic particles of either the ferromagnetic or paramagnetic variety are continuously fed through a classification volume and concentrate or magnetic particles are collected in a first outlet area with the non-magnetic particles or tailings collected in a second area. More specifically, a magnetic separator having its classification volume conformed to an existent magnetic field is disclosed.

SUMMARY OF THE PRIOR ART

Heretofore, continuous flow magnetic separators have been inefficiently designed with respect to the magnetic fields which they utilize. Typically, inlet manifolds feed a substantially circular conduit. The mix of concentrate and tailings is classified by a magnetic field extending parallel to the conduit flow path. Magnetic particles are classified to the outside where they experience decreasing flow velocity. Tailings are collected to the inside with correspondent concentric outlet apertures positioned for receiving the classified material. An example of such an apparatus is disclosed in Aubrey et al. U.S. Pat. No. 3,608,718.

Such devices have included a number of deficiencies. First, the flow path is not generated around and for conformance to a simple two pole magnetic field. Rather, the flow path is first selected and thereafter complex magnetic fields generated. Closely spaced opposed magnets having opposite fields are required with the result that much energy is wasted in generating magnetic field, or alternately, the field present is inefficiently used. It should be noted that with this type of device the spacial interval between the opposed magnets having the highest gradient lies without the useful classification volume.

Moveover, where opposed adjacent poles are used to provide a magnetic gradient, it has heretofore been found that such poles can only have imposed within them a useful magnetic field in the order of 12 kilo gauss before such poles become saturated. The result is that where successively larger and larger gaps are placed between poles, the same field force must span successively larger and larger classifying gaps. The result is that with larger separators, lesser magnetic gradients are available.

Additionally, in the prior art devices no attempt is made to concentrate magnetic fields for maximum classification at the collection point of the concentrate. The result is that the ratio of the concentrate collection area to the tailing collection area must be substantially large. Where inevitable entrainment of the tailings with the concentrates must occur, the larger the collection area required for the concentrate, the larger the proportional entrainment of tailings with the concentrate will occur. Consequently, the percentage classification achieved in any given pass through a classifier is smaller.

Finally, and more importantly, in the prior art magnetic particles are attracted to the sidewalls of the separator normal to the flow path. At such positions, they frequently stop and impede the flow of magnetic and non-magnetic particles through the separator volume. The result is that the velocity of materials passing through the device is restricted. No attempt has heretofore been made to use the magnetic field to assist the magnetic particles flowing through the device.

SUMMARY OF THE INVENTION

A continuous flow magnetic particle separator and accompanying classification method is disclosed for ferromagnetic and paramagnetic particles. A magnetic field is generated, preferably by a coil or solenoid mounted interiorly of a cylindrically configured ferromagnetic conductor. The classification volume is located in a typically toroidal volume interior of the magnetic field. The field is typically confined by a ferromagnetic conductor where it passes externally of the classification or toroidal volume. The toroidal volume is positioned so that lines of magnetic intensity from the field extend transversely to toroidal volume at the flow from input to collectors. The classification volume has a large gap in the vicinity of the input and tapers to a smaller gap in the vicinity of the concentrate (or magnetic particle) and tailings (or non-magnetic particle) collectors. The concentrate collectors are immediately adjacent to both walls of the toroidal classification volume. The tailings collector is between the concentrate collectors. Where a ferromagnetic conductor is conformed to the classifying volume walls, concentration of a three-dimensional magnetic field results. As a result, the collection area for non-magnetics or tailings can be maximized, and the collection area for the magnetics or concentrates can be minimized with the resultant inevitable entrainment of non-magnetic tailings in the concentrate held to a minimum. Further, the magnetic field assists magnetic particles in passing through the classifier. Water washing of the concentrate exit to prevent magnetic clogging is disclosed.

OBJECTS, FEATURES AND ADVANTAGES OF THE INVENTION

An object of this invention is to disclose a separator which has its flow path complementary to a north-south magnetic field. According to this aspect of the invention, a polar magnetic field is generated, typically by a coil. A toroidal volume containing the classification volume is placed so that the classification volume is intercepted by the magnetic lines of the generated field. By the expedient of placing the toroidal volume for classification in a gap across the magnetic field lines, classification in a north-south magnetic field is made possible.

An advantage of this aspect of the invention is that the generation of complex magnetic fields with closely spaced opposing field elements all generating opposing magnetic fields is not required. As a result, greater energy efficiency in the generation of and use of the magnetic field results.

Moreover, closely spaced and saturated opposed magnetic poles are not required. Instead, an increasing and concentrated magnetic force can be generated to both assist classification of magnetic particles to the chamber walls as well as to assist the flow of particles through the separator.

A further object of this invention is to disclose a separator feed manifold for placing mixed concentrate and tailings into the classification volume which can be placed with minimal interference to the ambient magnetic field. According to this aspect of the invention, the separator input manifold is toroidal in shape and positioned around the magnetic lines of force passing interiorly of the concentrated magnetic field. The magnetic lines of force, preferably conducted interiorly of a ferromagnetic material, loop around the separator.

An advantage of this aspect of the invention is that the separator feed manifold does not contribute to the gap in the loop of the magnetic field. Consequently, the input does not substantially lessen the classifying magnetic field used.

A further advantage of this invention is that the input manifold can have plug flow devices for promoting uniform classification velocities throughout the classifying volume without substantially increasing interference with the required classifying magnetic field.

A further object of this invention is to disclose a separator having a concentrated three-dimensional magnetic field with the highest magnetic force in the vicinity of the concentrate collection points. According to this aspect of the invention, the sidewalls of the classifying volume taper from a relatively large cross sectional area at the input, to a relatively narrow cross sectional area at the concentrate and tailing outputs. Where a ferromagnetic conductor is juxtaposed or adjacent to the chamber sidewalls, a concentrated three-dimensional magnetic field located at the concentrate collection point results.

An advantage of this aspect of the invention is that collection of concentrate occurs adjacent both chamber walls at two areas. The concentrate collection areas can be made of minimal area and the tailing collection area of maximum area.

A further aspect of the concentrated magnetic field of this invention is that the concentrate entrains minimum amounts of tailings. The collection area for concentrate is kept at a minimum. Non-magnetic particles tend to migrate both to the concentrate and tailing discharges substantially directly proportional to their respective concentrate and tailings collection areas and velocity distribution across the classifying volume. The reduction of the concentrate collection area to a minimum correspondingly reduces the collection of non-magnetics or tailings at the concentrate collection areas to a minimum.

A further advantage of the concentrated magnetic field is that the provision of some longitudinal gradient to the point of collection has been found to result in minimum flocculation. Moreover, the concentrated magnetic field helps move the particles to and through the classifying zones. The flow direction and the magnetic particle classification direction are substantially the same.

A further object of this invention is to disclose a fluid wash, typical of either air or water, to prevent magnetic clogging. According to this aspect of the invention, a water stream is directed along the tapering channel sidewalls down and through and into the concentrate collector.

An advantage of this aspect of the invention is that magnetic particle clogging can be prevented in the relatively small area of the concentrate collector. Magnetic particles which tend to cling to the chamber sidewalls and clog the concentrate collector are dislodged by the water jet stream.

Other objects, features and advantages of this invention will become more apparent after referring to the following specification and attached drawings in which.

Figure 1:
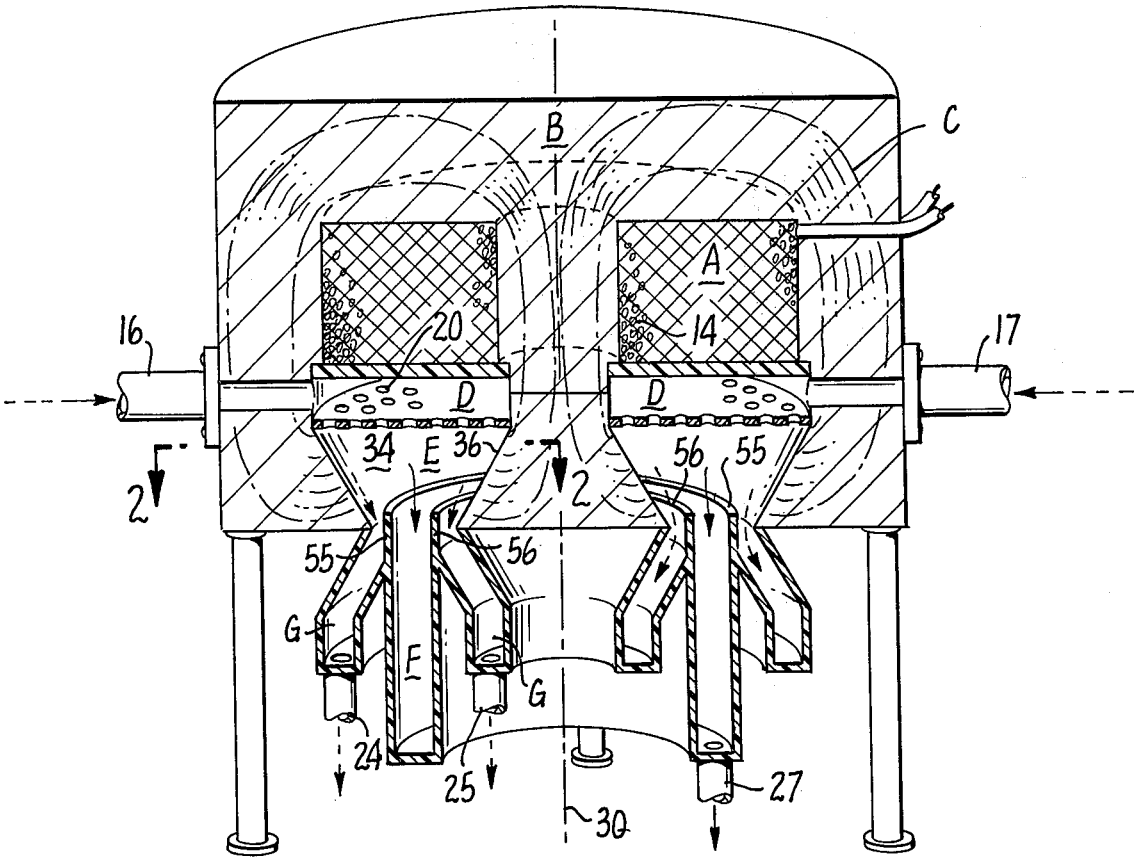
FIG. 1 is a perspective section illustrating one half of a magnetic classifier according to this invention showing a coil magnet in a ferromagnetic cylindrical housing defining in the interior a toroidal shaped classification volume located intermittently between an input manifold adjacent a coil, and output tailing and concentrate collection manifolds at the bottom.

Referring to FIG. 1, a coil A is shown embedded interiorly of a substantially cylindrical block of ferromagnetic conductor B. Coil A, by having its turns 14 (here shown as cylindrical) conducting an electrical current, produces a magnetic field shown schematically as broken lines C.

Paired input conduits on lines 16, 17 disburse unclassified tailings and concentrates into a toroidal-shaped input manifold D. Input manifold D, through plug constructions 20, furnishes the unclassified concentrate tailings mixture into a toroidal-shaped classification volume E at a uniform rate of flow which is common in the art. The magnetic particles are classified to the toroid walls and emerge as concentrates in paired concentric collector manifolds G, each manifold being adjacent the chamber walls. The non-magnetic tailings remain in the main flow stream and are collected at the concentric tailings collector manifold F between the paired concentric concentrate collector manifolds. The respective concentric manifolds G through one or more conduits 24, 25, empty concentrate on a continuous basis. Similarly, the concentric tailings collection manifold F, through one or more conduits 27, empty tailings on a continuous basis.

Figure 2:
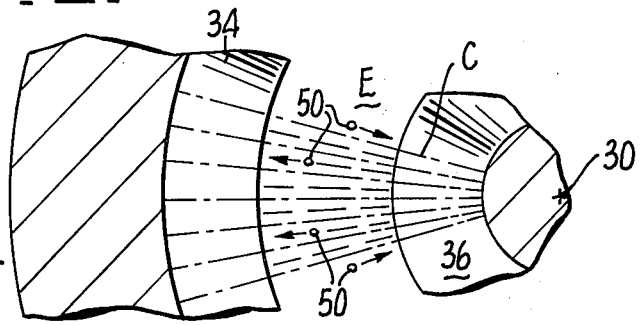
FIG. 2 is a fragmentary diametric or plan cross section taken along lines 2—2 of FIG. 1.
Figure 3:
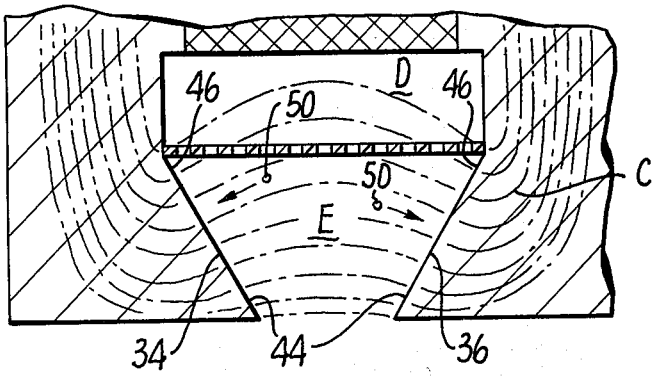
FIG. 3 is an enlargement of a radial and vertical segment of the collector volume illustrating the concentration of the magnetic field.

The production of the magnetic field C in the ferromagnetic core B by the coil A is illustrated in FIG. 1. In FIGS. 2 and 3, the segments of the field in the classifying volume are shown. Precisely, the electromagnetic field C generates a continuous field which intercepts the classification volume. The classification volume happens to be here shown as concentric and symmetrical with respect to an axis 30 passing through the center of the cylindrical ferromagnetic conductor B.

When current is induced to flow interiorly of the turns 14 of the coil A, a symmetrical magnetic field is generated with respect to the axis 30 passing concentrically through the separator. Where the area through which the flux flows is decreased, the magnetic flux per unit area will increase. Where the area through which the flux flows increases, the magnetic flux per unit area will decrease. It can be readily seen, through the cross section of the view of FIG. 1, that the field line C will tend to flow symmetrically around coil A in a continuous loop.

Classifying volume E is placed in the loop so as to interrupt the generated magnetic field. As can be seen, the volume E is toroidal in shape having a downwardly convergent frustroconical outside wall 34, and an upwardly convergent frustroconical inside wall 36. Thus, volume E tapers from a relatively large dimension at manifold D to a narrow and smaller dimension at the concentric tailings collector F and concentrate collectors C.

Referring to FIG. 2, the theoretical lines of magnetic flux C are drawn in broken lines in plan over a segment of the classification volume B. The intensity of the field is dominant adjacent axis 30 and has a lesser force adjacent downwardly convergent frustroconical wall 34. Thus, magnetic gradient bridging the gap created by the toroid classification volume E will be of greater density to the interior of the toroid and of lesser density to the exterior of the toroid.

Referring to FIG. 3, another aspect of the three-dimensional magnetic field created by the walls can be understood. It is known by those skilled in the art that the magnetic lines of flux tend to depart and enter a ferromagnetic conducting surface at a normal to the walls of the surface. It can thus be seen that the lines of flux are concentrated in an upward and arcuate direction. This occurs across the gap of the classification volume E.

Still referring to FIG. 3, it s known by those skilled in the magnetic arts that where the gap is created in a ferromagnetic conductor across a field path, the density of the magnetic flux will be greatest at the point where the gap is the narrowest and the reluctance to the magnetic field the smallest. Accordingly, a relatively weak magnetic field will be generated across the wide gap at the top portion 46 of the toroidal-shaped classification volume E. Conversely, a relatively strong magnetic field will be generated across the narrow gap 44 at the bottom of the toroidal-shaped volume E.

Understanding this much, two phenomena of this invention can be made clear. First, the magnetic particles 50 will be attracted by the lateral gradient to the walls 34, 36 of the chambers. Second, as the magnetic particles 50 fall, they will be drawn from the upper portion 46 of the classifying volume E adjacent manifold D to the lower portion of the volume. They will undergo a maximized magnetic force towards the walls and towards the bottom 44 of the toroid classification volume E at their point of collection to concentric concentrate collectors G.

Understanding the effect of the magnetic field, the discussion of the dynamic forces of fluid flow and magnetic classification can now occur. First, the relative collection areas of the concentric trailing manifold F and its surrounding and concentric concentrate manifolds G will be discussed. Thereafter, the use of these respective collection areas in collecting the respective concentrate and tailings will be set forth.

Referring to FIG. 1, it will be noted that tailings collection manifold F is defined in the spatial interval between an outer concentric wall 55 and an inner concentric wall 56. As is well known, the interval between walls 55 and 56 define an area equal to the circular area included by the inside diameter of wall 55 less the circular area included by the outside diameter of wall 56.

The area of the outer concentric concentrate collector manifold G at the point of collection is equal to the circular area of outside wall 34 less the circular area of the outside diameter of wall 55. Similarly, the inner collection area of inner manifold G can be determined by the difference between the area enclosed by the inside diameter of wall 56 less the area of the outside diameter of wall 36 at the point of collection.

Because of the magnetic forces generated, it is preferred to keep the area of collection of the tailings manifold F large (here shown in the order of 70% of the total collection area). Conversely, and because of the magnetics, it is preferred to keep the collection area G small (here shown in the range of 30%).

It should be understood that dependent upon the variables of the particles being classified, the respective area ratios of the concentrate collector to the tailings collector can vary. Such variables can include percentage of tailings and concentrate present, magnetic permeability of the concentrate, particle size, flow rates, presence of water or air in flow, and the like.

Referring to the example of the concentrate-tailing collector area ratios given above, the operation of the classifier to classify material flowing between the input manifold D and the respective collection manifold F, G can be understood by first considering the case where flow occurs and no magnetic force is present. Thereafter, the classification can be understood by considering the case where a magnetic flux is applied across the classifying volume E.

Typically, manifold D is designed to give a uniform flow to the interior of the classifying volume E. Thus, in the absence of any magnetic field whatsoever, 30% of the material passing through the separator would be collected at concentrate manifold G and 70% of the material passing through the separator would be collected at the tailings manifold F. Undisturbed and uniformly mixed flow could occur between the input manifold D and the respective collection manifolds F, G.

Assuming that magnetic flux is applied across the walls of the classification volume E, and further assuming that there is no entrainment of tailings with the classified magnetic particles, operation of the classifying device can at least be theoretically understood. Typically, as a uniformly mixed flow is introduced interiorly of the classifying volume E, both magnetic and non-magnetic particles will proceed to the respective collection manifolds. Non-magnetic particles will proceed at a rate proportional to the solid flow rate to the respective collection manifold F, G. In the specific example above, 70% of all non-magnetic particles F will be received at tailings manifold F; 30% of all non-magnetic particles will be received at concentrate manifolds G.

The same will not be true for the magnetic particles. These particles will be drawn downwardly and to the sides of the toroidal-shaped classification volume E. Specifically, almost all of the magnetic particles will find their way to the concentrate collection manifolds G.

It should be noted that this magnetic gradient to the collector forms an important distinction of this separator over the prior art. The gradient there assists magnetic particle flow through the classification volume of the separator. Concentrate is not only drawn to the walls of the classifying volume, but additionally draws through the separator to the point of collection.

Thus, the present invention distinguishes over the prior art especially in the velocity of the magnetic particles at the walls of the separator. Heretofore, magnetic particles were drawn to classifier wall by forces normal to the fluid flow path. Since friction of the separator sides naturally slows particle flow adjacent the walls and since the magnetic particles are drawn transversely to the fluid flow to the walls, clogging of the classifying volume could easily occur. As contradistinguished from the prior art, the tendency of the magnetic gradient to pull the particles through the separator adjacent the chamber walls substantially reduces the tendency of the particles to clog the classifying volume.

It can thus be seen that the outflow of tailings to the tailings manifold F will be substantially purified of magnetic particles of various iron ores, such as pulverized taconite. It will of course be apparent that the separator can be used in any number of magnetic — non-magnetic classifications.

It will be immediately appreciated by those skilled in the art that any number of the separators herein disclosed can be placed in series. Moreover, sequential passes of either the tailings or the concentrate through a single separator will result in increasing degrees of classification of the magnetics from the non-magnetics.

Figure 4:
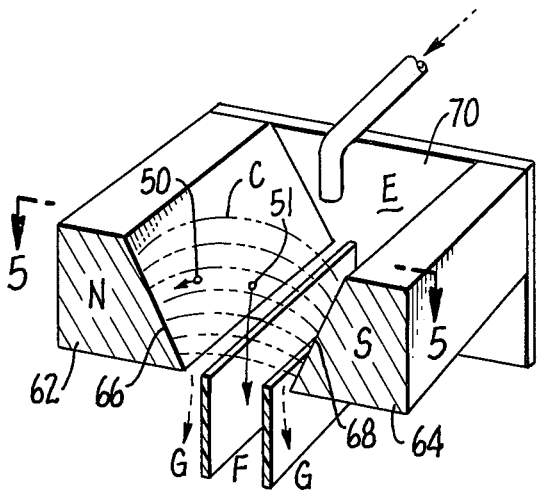
FIGS. 4 and 5 are perspective and plan respective views of a classifier according to this invention having an infinitely long radius of curvature with the concentrated magnetic field of this invention.
Figure 5:
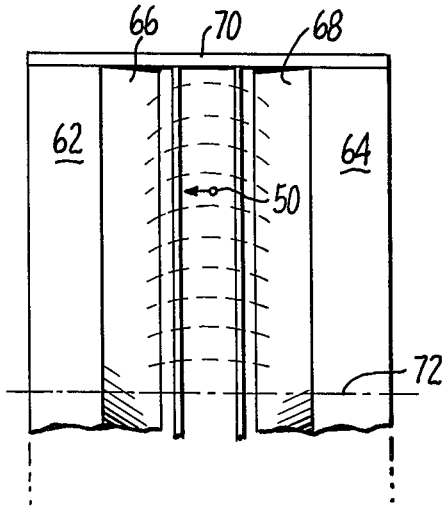

It will be realized by those skilled in the art that the toroidal-shaped volumes herein disclosed created substantially concentric with the magnetic field produced by a coil are not absolutely required for the practice of at least some aspects of this invention. For example, all those skilled in physics realize that a toroid of infinite radius is equivalent to a linear dimension. Referring to FIGS. 4 and 5, such a classifier is illustrated.

Referring to FIG. 4, magnetic polarity in paired opposed ferromagnetic conductive cores 62, 64 is applied between the converging walls 66 on core 62, and 68 on core 64. As the lines of flux C depart and enter, the walls of the classification volume E substantially normal thereto, the vertical concentrate of the lines of flux C is arcuate and upward similar to that illustrated with respect to the section of FIG. 3. Moreover, in the views of FIGS. 4 and 5, the magnetic gradient 50 will be to the sidewalls and the magnetic gradient 51 to the collection manifold G. Thus, magnetic particles will be urged towards the narrowest gap of the classifier and to one of the walls 66, 68 where collection can occur precisely as illustrated before.

It should be realized that the embodiment of FIGS. 4 and 5 is not as efficient as the embodiment of FIG. 1. The embodiment does, however, produce the desired concentrated three-dimensional field which has been found preferable for the classification herein described.

Figure 6:
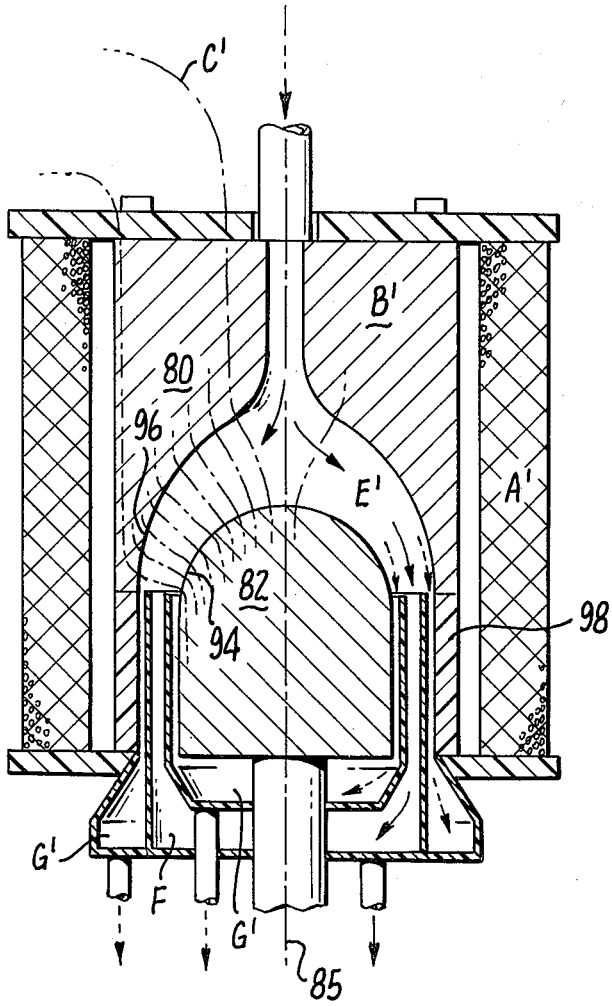
FIG. 6 is an alternate embodiment of the classifier shown in FIG. 1 having opposed annular and concentric poles.

Referring to FIG. 6, yet another embodiment of this invention is illustrated. In FIG. 6, the classification volume E′ has been moved centrally and interior of a ferromagnetic core B′ interior of a coil A.

Referring to FIG. 6, the classification volume E is defined between an annular core 80 and a substantially hyperboloid core 82. A feed of mixed concentrate and tailings occurs concentrically to the core along its axis 85. Magnetic lines of flux C′ extend across the classification volume E′.

As previously illustrated, the opposed converging walls 94, 96 of the collector attract the magnetic particles thereto. These particles are subsequently received at the concentric paired inside and outside concentrate collector manifolds g′ having openings concentric and about the interior wall and exterior wall of the collector. Tailings are received at an annular concentric tailings collection manifold F.

From the point of collection, outside and annular force B is provided with a cylindrical non-magnetic section 98. Non-magnetic section 98 serves to channel the magnetic circuit directly across the point of collection with highest intensity and channels the magnetic field C interiorly of the pole 82 almost in the entirety.

It will be realized that the ferromagnetic conducting path is only partially shown in FIG. 6. The surrounding ferromagnetic conductor is not shown.

Figure 7:
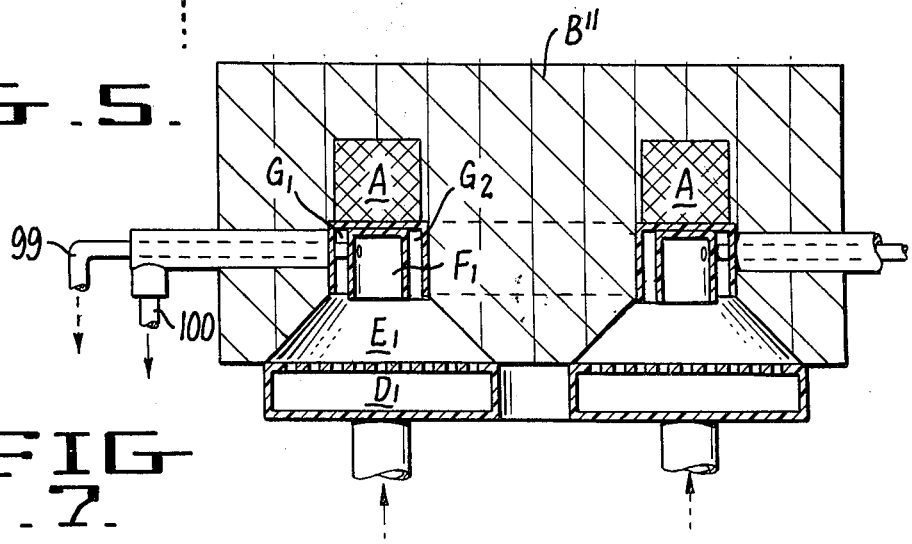
FIG. 7 is a classifier according to this invention wherein the flow of fluid to be classified is upwardly to a classifying area adjacent the central portion of laminated core.

Referring to FIG. 7, an alternate embodiment of the invention is illustrated. Specifically, a coil A is shown located within a laminated ferromagnetic conducting core B″.

With regard to the lamination of the core B″, the laminations each consist of a series of concentric circular cylinders placed one inside another. The cylinders are interrupted to provide spatial intervals for the coil A, the toroidal classification volume E, the concentrate collection manifolds $G_1$ and $G_2$ and the tailing collection manifold $F_1$.

It will be noted that the mixture of tailings and concentrate is introduced interiorly of an inverted classification volume $E_1$ from an inlet manifold $D_1$. The mixture of tailings and concentrate is introduced with an upward fluid flow, typically of water, and is funnelled through the classifying volume $E_1$ with forces similar to those previously described. Thereafter, the respective manifolds discharge their flows with tailings being discharged through conduit 99 and concentrate being discharged at conduit 100. It will be understood that the direction of classification here shown is the reverse of that previously illustrated in FIG. 1.

Figure 8:
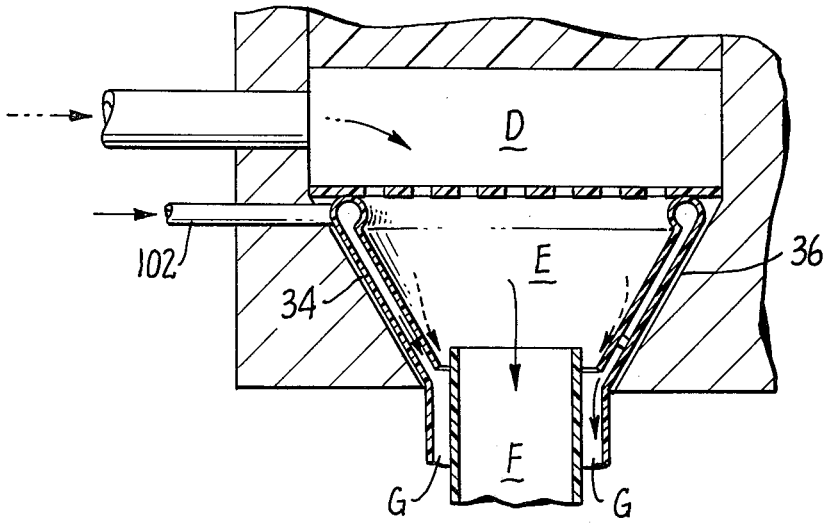
FIG. 8 illustrates a portion of a classifier similar to that disclosed in FIG. 3 having a water wash to prevent magnetic clogging at the point of collection.

Referring to FIG. 8, the use of this invention with a water wash at the magnetic collector G is disclosed. Remembering that FIG. 8 is a vertical section of a radius of a concentric separator similar to that shown in FIG. 1, the water washing can be understood. Broadly, water mixed tailings and concentrate are introduced through manifold D. Paired water inlet conduits 102 supply water to the walls 34, 36 of the classifying volume E between non-magnetic conduit walls. Water passes between the non-magnetic walls of the conduit and washes the concentrate collection manifold G at the point of collection. The result is that accumulated magnetic particles at the collection point of concentrate manifold G are swept away in the water discharge. Magnetic clogging due to the attraction and accumulation of magnetic particles at the narrow inlet to concentric concentrate manifolds G is prevented.

Figure 9:
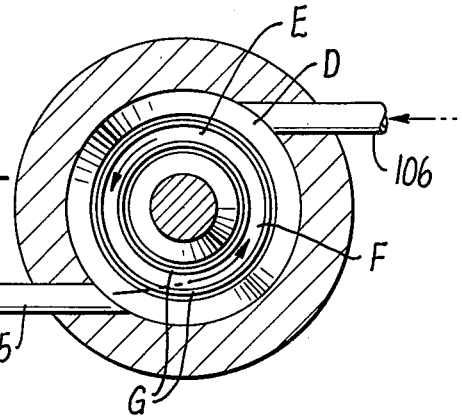
FIG. 9 is an embodiment of the input feed manifold illustrating a cyclonic input.

Referring to FIG. 9, it should be apparent to those skilled in the art that the inlet manifold D is not specifically required. For example, the concentric disposition of the classifying volume E easily lends itself to paired intake conduits 105, 106. Such conduits introducing a fluid entrained flow (preferably water) into the toroidal-shaped classification volume E can uniformly mix the tailings concentrate mixture to allow a magnetic classification as the tailings and concentrate spiral downwardly to points of collection at the respective tailings manifold F and concentrate manifold G.

Figure 10:
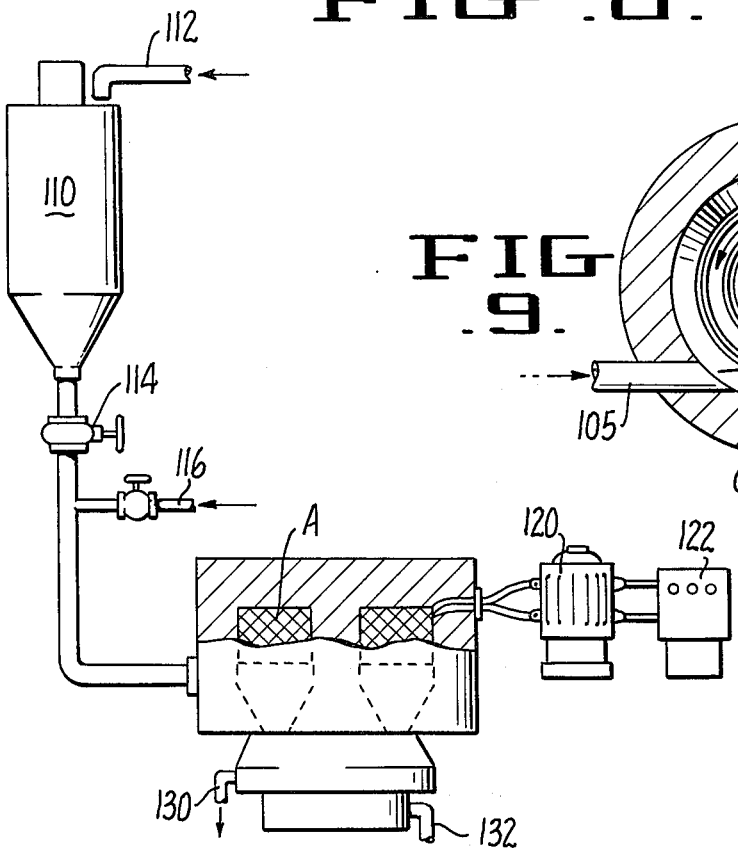
FIG. 10 is a schematic illustrating apparatus for operating the classifier of this invention.

A system incorporating the apparatus of this invention with a dry feed is illustrated in FIG. 10. Specifically, hopper 110 has the mixed tailings and concentrate introduced through a conduit 112. Typically, hopper 110 is opened through valve 114 and the outflow thereof intermixed with an air jet through piping 116 to flow interiorly of the separator of this invention. A motor generator 120 is controlled in output by control panel 122 and energizes the coil A. Classification interior of the separator occurs typically as described in FIG. 1. A continuous outflow of concentrate at conduit 130 and tailings at conduit 132 results.

Figure 11:
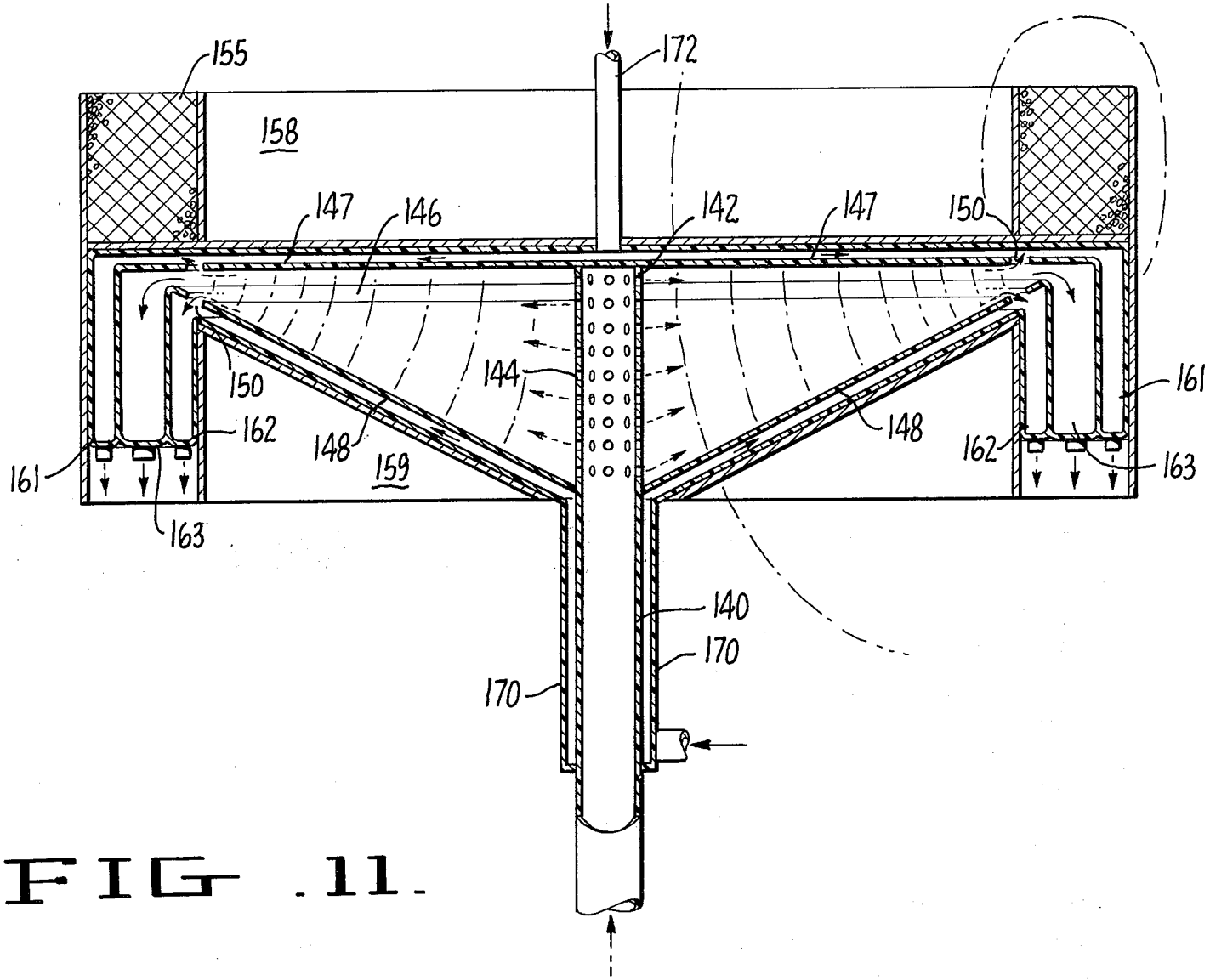
FIG. 11 is a preferred embodiment of this invention having a reduced particle velocity at the point of classification.

Referring to FIG. 11, yet another and preferred embodiment of this invention is illustrated A concentric feed manifold 140 feeds mixed tailings and concentrate to a central disbursing conduit or manifold 142 typically entrained in a flow of water. Disbursing manifold 142 disburses mixed concentrate and tailings radially outward.

The classification volume 146, generally toroidal in shape, is defined between converging walls 147 and 148. As can be seen, wall 147 is horizontal and circular. Wall 148 is frustoconical, circular and slopes upwardly from manifold 142 to the collection area 150. As the view of FIG. 11 is a section taken through a circular collector, it will be appreciated that the collection area 150 is circular and surrounds volume 146.

The magnetic field is provided by a coil 155 having electrical current flowing through its individual turns. Typically, a ferromagnetic conductor 158 adjacent wall 147, and a ferromagnetic conductor 159 adjacent wall 148 completes a magnetic circuit between the converging walls 147, 148.

Collection occurs at paired concentrate collection manifolds 161 and 162 and at the tailings collection manifold 163 there between. Remembering that magnetics will be drawn transversely to each of the walls 147 and 148, and by the increasing magnetic gradient to the narrowest gap between the walls, it will be seen that the concentrate collection manifolds 161, 162 are positioned so that they communicate to the magnetically classified particles flowing along the magnetized walls. Similarly, tailings collection manifold 163 is communicated to the flow area between the walls so that tailings are classified to the tailing manifold and its outputs.

By placing the feed in an entrained fluid flow, typically water, the collector herein illustrated produces a particularly desired effect. It will be noted that the particle flow is horizontal and even upwardly. This flow causes a maximum velocity at the input manifold 142 and a minimum velocity at the collection point 150.

The result is that the magnetic particles reach their minimum flow velocity at their maximum point of magnetic attraction to the walls. Particularly advantageous classification of the magnetics or concentrate occurs.

Where the magnetics are traveling at the relatively low velocity at their point of collection, magnetic clogging can easily occur. To abate this clogging, water is inflowed through conduits 170 and 172 in a stream flow along the chamber walls. The water is exposed at the chamber walls at the collection point 150. Magnetic particles drawn to this point are entrained in the water flow and forced out the concentrate collection manifolds 161, 162.

It should be appreciated that the apparatus of FIG. 11 has much in common with the apparatus of FIG. 6, the main difference being in the substantially horizontal and partically upward flow of the particles to be classified. Additionally, this embodiment is illustrative of the principal that the manifolds need only be positioned so that they communicate to the particle flow inherent to the apparatus. Specifically, the concentrate collection manifolds must be communicated to the particle flow adjacent the classification volume walls. Similarly, the collection manifold must be communicated to the particle flow intermediate the chamber walls.

It can also be seen that the disclosure herein discloses a process for classifying mixed magnetic concentrate and non-magnetic tailings. Broadly, the process includes the step of providing a north-south pole magnetic field, this field being either of constant or alternating polarity. A classification volume is placed so as to intercept at least a portion of the north-south magnetic field. The classification volume is defined between converging walls. Each of the converging walls has a ferromagnetic conductor juxtaposed to the walls so that the concentration of the magnetic field occurs to provide a first magnetic gradient towards the chamber walls and a second magnetic gradient towards the point of closest convergence between the chamber walls. It should be apparent that any device which would serve to concentrate the magnetic field in increasing gradient as well as to the chamber walls will serve the magnetic field function of this invention.

It should be apparent to those skilled in the art that the invention herein disclosed will admit of modification. For example, the magnetic fields here illustrated could be generated by permanent magnets placed generally centrally of the toroidal-shaped volume E. Alternately, the coil magnets here shown could be energized by either AC current or DC current. Moreover, the coils could be superconducting and could be hollow, internally cooled or even cryogenic.

The flow of the particles to be classified through the separator has herein been illustrated as continuous. Some classification conditions will be met where cyclic or interrupted flows are preferred.

The classification volume of the separators of FIGS. 1, 6, 7, 8, 9, 10 and 11 have herein been described as toroidal in shape. This toroid has been described as rotating the section of the classifier volume described by the closed figure having an input at one end, an output at an opposite end, and the two typically converging sidewalls there between about a central axis of the separator. Although toroids are typically defined by rotating a circle about a central axis, it will be understood that the toroidal volume herein described can include rotating a figure closed by straight lines around such an axis (line 30, FIG. 1).

Likewise, and especially with reference to FIG. 1, it will be observed that the magnetic lines of flux of the field C are confined to a toroidal path about the center of the core by the high permeability ferromagnetic conductor B. Again, although these lines are not precisely circular, the term 'toroidal-shaped' has been used to describe the path of the produced field.

Likewise, other modifications may be made without departing from the spirit and scope of the invention.

We claim:

1. A magnetic particle separator for classifying paramagnetic or ferromagnetic concentrate from non-magnetic tailings comprising: means for generating a north-south pole magnitude field; a toroidal high permeability ferromagnetic conductor communicated to said north-south magnetic field; a toroidal-shaped classification volume defined to interrupt said high permeability ferromagnetic conductor between opposite walls positioned to place an air gap across which magnetic lines of flux of said field must pass; said toroidal-shaped classification volume having cross-sectional area bounded by an input at one end, an outlet at the other end, and walls connecting said input and outlet, and said volume generated by rotating said cross-sectional area substantially about the north-south pole of said magnetic field; an input means for inputting to said toroidal-shaped classification volume across said lines of flux a flow of non-classified concentrate and tailings; and, concentrate collector manifolds communicated to said toroidal-shaped classification volume for collecting concentrate, one said concentrate collector manifold immediately adjacent to one wall of said toroidal-shaped classification volume, the other said concentrate collector manifold immediately adjacent to the other wall of said toroidal-shaped classification volume, and a concentric tailings collection manifold communicated to said toroidal-shaped classification volume intermediate said concentrate collector manifolds for collecting tailings.

2. The invention of claim 1 and wherein said means for generating a north-south pole magnetic field includes a coil having at least one electrical loop and means for energizing said electrical loop.

3. The invention of claim 2 and wherein said electrical loop is energized with alternating current.

4. The invention of claim 2 and wherein said electrical loop is energized with direct current.

5. The invention of claim 1 and wherein said toroidal-shaped classification volume is defined between converging opposite walls, said opposite walls converging from a wide separation at said collector manifolds.

6. The invention of claim 1 and wherein said means for generating a north-south pole magnetic field includes means for concentrating said field at said concentrate collector manifolds.

7. The invention of claim 1 and wherein said input means includes a toroidal-shaped manifold overlying said toroidal-shaped classification volume.

8. The invention of claim 1 and wherein said input means includes at least one conduit for introducing a substantially cyclonic flow of non-classified concentrate and tailings into said toroidal-shaped classification volume.

9. The invention of claim 1 and wherein said input means inputs wet concentrate and tailings.

10. The invention of claim 1 and wherein said input means inputs dry concentrate and tailings.

11. A continuous flow magnetic particle separator for classifying magnetic and paramagnetic concentrate from non-magnetic tailings including: a toroidal-shaped classification volume defined between first and second converging walls, said sidewalls converging from a wide separation at one point to a narrow separation at a second point; said toroidal-shaped classification volume having a cross-sectional area bounded by an input at one end, an outlet at the other end and said walls connecting said input and outlet, and said volume generated by rotating said cross-sectional area about an axis; means for generating a two pole magnetic field substantially aligned to said axis a toroidal high permeability magnetic conductor for communicating said field to said said narrow separation between said walls; and, collector means communicated to said narrow separation between said walls including concentrate collectors communicated to particle flow paths, each of said walls and an intermediate tailings collector manifold communicated between said concentrate collector manifolds, and input means for placing non-classified tailings and concentrate itno said classification volume to pass said non-classified tailings and concentrate across said lines of flux for classification by said longitudinal and transverse gradients.

12. The invention of claim 11 and wherein said input means for placing non-classified tailings and concentrate into said classification volume includes means for flowing said non-classified tailings and concentrate at a preselected velocity towards said collector means.

13. The invention of claim 11 and wherein said classification volume has said wide separation at the lower elevation and said narrow separation at the upper elevation and said input means is at said lower elevation and said collector manifolds are at said upper elevation.

14. The invention of claim 11 and wherein said input means includes a manifold for uniformly distributing a flow of non-classified concentrate and tailings to said classification volume.

15. The invention of claim 11 and wherein said magnetic conductor is a ferromagnetic laminated conductor.

16. The invention of claim 15 and including means for providing a washing stream of fluid at said concentrate collector manifolds for preventing clogging of said concentrate collector manifolds.

17. A process for classifying a continuous flow of mixed magnetic and paramagnetic concentrate and non-magnetic tailings comprising: providing a north-south pole magnetic field having a high permeability conductor confining the lines of flux to a substantially toroidal path; providing a toriodal-shaped classification volume interrupting said high permeability path in said north-south pole magnetic field open between first and second sidewalls of said high permeability conductor; said toroidal-shaped classification volume having a cross-sectional area bounded by an input at one end, an outlet at the other end, and walls connecting said input and outlet, and said volume generated by rotating said cross-sectional area substantially about the north-south pole of said magnetic field; concentrating said magnetic field between said sidewalls to provide a first magnetic gradient toward said sidewalls and a second magnetic gradient towards concentrate collection points adjacent said sidewalls; passing said mixed tailings and concentrate between said sidewalls from an input at one end towards said concentrate collection points at the other end of said classification volume to cross said magnetic field at said gap and classify said concentrate with said first and second gradients; collecting immediately adjacent said sidewalls at said collection point said concentrate; and, collecting intermediate said sidewalls said tailings.

18. The process of claim 17 and wherein said passing step includes passing said mixed tailings and concentrate in a water mixture to said classifying volume.

19. The process of claim 17 and including the step of washing said concentrate away from said sidewalls of said classifying volume.

20. The process of claim 17 and wherein said walls of said provided toroidal-shaped classification volume converge from an input end to a collection end.

21. A magnetic particle separator for classifying paaramagnetic or ferromagnetic concentrate from non-magnetic tailings, said separator comprising: means for generating a north-south pole magnetic field; a toroidal high permeability magnetic conductor communicated to said north-south magnetic field, a toroidal-shaped classification volume defined between first and second walls of said high permeability conducted, said toroidal-shaped classification volume having a cross-sectional area bounded by an input at one end, an outlet at the other end, and walls connecting said input and outlet, and said volume generated by rotating said cross-sectional area substantially about the north-south pole of said magnetic field, said toroidal-shaped classification volume positioned to continuously intercept between said walls magnetic lines of flux of said north-south magnetic field; input means comprising a central manifold surrounded by said toroidal-shaped classification volume for inputting to said toroidal-shaped classification volume a flow of non-classified concentrate and tailings between said walls; a plurality of concentrate collector manifolds communicated to said toroidal-shaped classification volume for collecting concentrate, one of said concentrate collector manifolds communicated to said first wall to collect concentrate flowing adjacent said wall, the other of said concentrate collector manifolds communicated to said second of said walls to collect concentrate flowing adjacent said second wall, and at least one tailings collector manifold communicated to said defined classification volume intermediate said concentrate collector manifolds for collecting tailings.

* * * * *